US007097471B2

(12) United States Patent
Narui

(10) Patent No.: US 7,097,471 B2
(45) Date of Patent: Aug. 29, 2006

(54) ANISOTROPIC ELECTRICAL CONNECTOR WITH ATTACHING PART AND METHOD FOR MANUFACTURING THE SAME

(75) Inventor: Akira Narui, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 393 days.

(21) Appl. No.: 10/210,502

(22) Filed: Aug. 1, 2002

(65) Prior Publication Data

US 2003/0032315 A1 Feb. 13, 2003

(30) Foreign Application Priority Data

Aug. 9, 2001 (JP) ..... 2001-241739

(51) Int. Cl.
*H01R 4/58* (2006.01)

(52) U.S. Cl. ..... 439/91; 439/66

(58) Field of Classification Search ..... 439/91, 439/66, 86, 591

See application file for complete search history.

(56) References Cited

U.S. PATENT DOCUMENTS

| | | | | | |
|---|---|---|---|---|---|
| 4,664,458 | A | * | 5/1987 | Worth | 439/82 |
| 5,163,837 | A | * | 11/1992 | Rowlette, Sr. | 439/91 |
| 5,232,372 | A | * | 8/1993 | Bradley et al. | 439/66 |
| 5,975,914 | A | * | 11/1999 | Uchida | 439/66 |
| 6,168,442 | B1 | * | 1/2001 | Naoi | 439/91 |

* cited by examiner

*Primary Examiner*—Michael C. Zarroli
(74) *Attorney, Agent, or Firm*—McGlew and Tuttle, PC

(57) ABSTRACT

An anisotropic connector part (2) made of a rubber elastic element having a conductive part formed by orienting a desired place of a conductive medium by means of a magnetic force and an attaching part (4) having engaging parts (3) to be attached to electronic parts or a substrate are integrating into one place, thereby making it possible to easily perform attachment to the electronic parts or the substrate and also reduce a manufacturing cost and a mount space.

15 Claims, 3 Drawing Sheets

FIG. 6
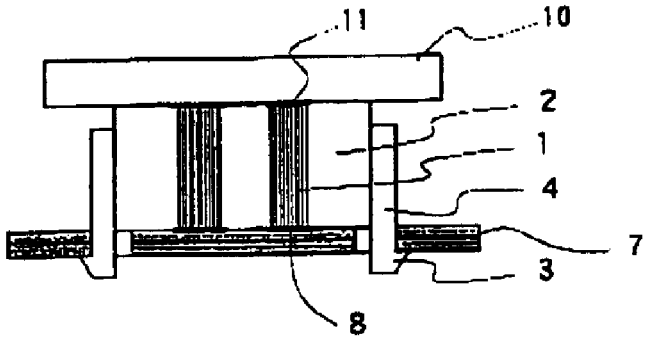
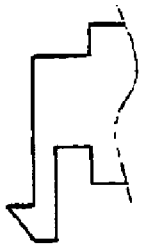
Fig. 7a
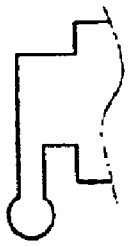
Fig. 7b
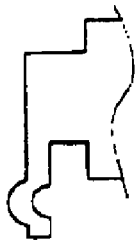
Fig. 7c
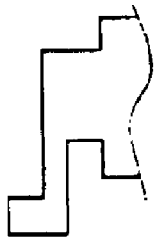
Fig. 7d

ANISOTROPIC ELECTRICAL CONNECTOR WITH ATTACHING PART AND METHOD FOR MANUFACTURING THE SAME

BACKGROUND OF THE INVENTION

1. Technical Field of the Invention

The present invention relates to a connector used for electrical connection of electronic parts which are built into information equipments such as portable cellular telephones, personal handy phone systems (PHS), personal digital assistants (PDA), etc. and various electrical equipments such as audiovisual equipments, personal computers, etc.

2. Prior Art

Examples of electronic parts to be built into electronic equipments such as portable cellular telephones or the like includes microphones, speakers, receivers, vibrators, motors, cells, memory cards, etc. As a method for electrically connecting electrodes of the electronic parts with electrodes of a substrate, there have been employed a method for connecting these electrodes by soldering using lead wires, a method for connecting these electrodes via metal plate springs or spring pins, etc.

Moreover, there has been used a method for electrically connecting the electrodes of the electronic parts and electrodes of the substrate by inserting a compression-type elastic connector such as a connector wherein elastic conductive rubbers and insulating rubbers are laminated one after the other, a connector wherein metal thin wires are oriented in a conducting direction in an elastic insulating rubber, etc. between the electrodes of the electronic part and the electrodes of the substrate and compressing it therebetween at the time of mounting of a case.

Since the conventional connecting method of electrodes by soldering via lead wires requires that fine lead wires be soldered by manual work, the productivity lowers and the costs increase. Moreover, due to the lead wires, a larger space is required, and this does not meet the needs for miniaturization of equipments. Also, the conventional connecting method of electrodes via metal plate springs or spring pins requires a large space and does not meet the needs for miniaturization.

Moreover, as for the method for connecting with a substrate via the elastic connector such as a connector wherein elastic conductive rubbers and insulating rubbers are laminated one after the other, a connector wherein metal thin wires are oriented in a conducting direction in an elastic insulating rubber, etc. at the time of mounting of a case, fine works are needed for positioning conductive parts of the elastic connector to the electrodes of the electronic parts and the substrate, resulting in low productivity and cost increase.

SUMMARY OF THE INVENTION

It is an object of the present invention to solve the above-mentioned problems and to provide a connector and a manufacturing method thereof wherein an anisotropic connector part and an attaching part to be attached to an electronic part or a substrate are integrated into one piece, thereby making it possible to simplify an assembly process of the connector and also reduce a manufacturing cost and a mount space.

In short, the present invention provides a connector in which an anisotropic connector part for connecting electrodes of electronic parts and electrodes of a substrate is integrated with an attaching part to be attached to the electronic parts or the substrate.

Further, the invention provides a connector in which the anisotropic connector part is made of a rubber elastic element having a conductive part formed by orienting a conductive medium by means of a magnetic force.

Further, the invention provides a connector in which the conductive medium is a magnetic conductive element.

Further, the invention provides a connector in which the attaching part is made of a material selected from the group consisting of a rubber elastic element, a rigid resin, metal, ceramics and a combination of them.

Further, the invention provides a connector in which the attaching part is provided with engaging parts for attaching the connector to the substrate or the electronic parts.

Further, the invention provides a method of manufacturing a connector in which an anisotropic connector part for connecting electrodes of electronic parts and electrodes of a substrate is integrated with an attaching part to be attached to the electronic parts or the substrate, comprising the steps of: pouring a liquid polymer mixed with a conductive medium into a metal mold; applying a magnetic force to a desired position in the metal mold to orient the conductive medium to define a conductive part so as to form the anisotropic connector part and cross-linking the liquid polymer to integrate the attaching part with the anisotropic connector part.

Further, the invention provides a method of manufacturing a connector in which an anisotropic connector part for connecting electrodes of electronic parts and electrodes of a substrate is integrated with an attaching part to be attached the electronic parts or the substrate, comprising the steps of: inserting a previously molded attaching part in a metal mold; pouring a liquid polymer mixed with a conductive medium into the metal mold; applying a magnetic force to a desired position in the metal mold to orient the conductive medium to define a conductive part so as to form the anisotropic connector part and cross-linking the liquid polymer to integrate the attaching part with the anisotropic connector part.

DETAILED DESCRIPTION OF THE PREFERRED EMBODIMENTS

The present invention will be described in detail with reference to the accompanying drawings.

As shown in FIG. 1, a connector In accordance with the present invention is an integrated piece of an anisotropic connector part 2 made of a rubber elastic element in which a conductive part 1 is formed by orienting a conductive medium by means of a magnetic force, an attaching part 4 having an engaging part 3 for attaching the connector to an electronic part or a substrate. Since the attaching part having the engaging part for being fitted into the electronic part or the substrate is integrated with an elastic anisotropic connector part, attachment to the electronic part or the substrate can be easily performed.

The anisotropic connector part in accordance with the present invention is an anisotropic conductive and compression type connector composed of the rubber elastic element in which the conductive part is formed. By connecting the anisotropic connector part with the electrodes of the electronic parts or the electrodes of the substrate while compressing the conductive part, electrical connection therebetween is stabilized.

The conductive part in accordance with the present invention may be formed by dispersing a conductive medium in a polymer or by aggregating a conductive medium in a polymer. A conductive part formed by aggregating a conductive medium dispersed in a liquid polymer by means of a magnetic force is easily produced and preferable. In this case, it is desirable that the conductive medium is a magnetic conductor such as nickel, iron, cobalt or the like because it can be aggregated by magnetic force and easily oriented in a state of being linked together. Moreover, the conductive medium may be a conductive metal such as alloy, gold, silver, copper, aluminum, etc. plated with a magnetic conductor composed mainly of nickel, iron, cobalt, etc., or contrary to it, a magnetic conductor plated with a conductive metal such as gold, silver, copper, etc.

As for a particle diameter of a conductive medium forming a conductive part, the larger the particle diameter is, the lower and the more stable resistance value is obtained. On the contrary, the smaller the particle diameter is, the more beautiful an anisotropic conductive part is obtained. Consequently, when it is required to obtain a low and stable resistance value and to form a beautiful conductive part, it is preferable to use a conductive medium of 20 μm to 50 μm particle diameter.

The attaching part in accordance with the present invention is not specifically restricted on the material if it is capable of holding an anisotropic connector part. It is desirable that the attaching part is composed of one of rubber elastic elements, rigid resins, metals, ceramics, or composite of these because such an attaching part is easily integrated with the anisotropic connector part and easily attached to the electronic parts or the substrate.

The engaging parts in accordance with the present invention is not specifically restricted if they have shapes that are easy to attach to the electronic parts or the substrate. Examples of shapes of the engaging parts are considered many shapes, etc., as shown in FIG. 7. By fitting such engaging parts into attaching positions of the electronic parts or the substrate, the connector is fixed. Alternatively, after being fitted into the electronic parts or the substrate, the connector may be bonded to the electronic parts or the substrate by adhesion, welding or the like, if necessary.

In the invention, the anisotropic connector part and the attaching part may be both integrally molded in a metal mold or integrated into one piece after being separately molded. Examples of configurations of the case where both the parts are integrally molded in the metal mold include a monochromatic configuration using an identical material, a configuration by an insert-integral molding using different materials, a configuration by a two-color integral molding using different materials, etc. Examples of configurations wherein both the parts are integrated into one piece after being separately molded include a configuration wherein the anisotropic connector part is penetrated by the attaching part, a configuration wherein both the parts are fitted by means of their projections and recesses, a configuration wherein both the parts are bonded to each other, etc.

In a manufacturing method in accordance with the present invention as shown in FIG. 2, a connector is produced by pouring a liquid polymer mixed with a conductive medium into a metal mold 5, applying a magnetic force to a desired position in the metal mold to orient the conductive medium to define a conductive part 1 so as to form an anisotropic connector part 2 and cross-linking the liquid polymer to integrate an attaching part 4 with the anisotropic connector part 2.

The viscosity of the liquid polymer mixed with the conductive medium in accordance with the present invention exerts an influence on the orientation time of the conductive part. The lower the viscosity is, the shorter the orientation time is, and this is advantageous for a forming cycle. However, since there is a tendency that the lower the viscosity of the polymer is, and the physical properties becomes worse after being cured, a desirable viscosity of the liquid polymer mixed with the conductive medium is 10 P (poise) to 2500 P, more preferably, it is 100 P to 1000 P.

As for integral molding of the anisotropic connector part and the attaching part in accordance with the present invention, they may be integrally molded using either an identical material or different materials. In case of integral molding with an identical material, the anisotropic connector part and the attaching part can be integrally molded in one process, and the productivity is increased. In case of integral molding with different materials, the attaching part can be prepared with various desired materials, and shapes or materials of the attaching part can be selected properly according to methods for fixing or bonding connectors.

BRIEF DESCRIPTION OF THE DRAWINGS

FIG. 6 shows a longitudinal sectional view showing an example of the connector in accordance with the present invention attached to the substrate.

FIG. 7*a* shows a view showing a claw shaped engaging part.

FIG. 7*b* shows a view showing a spherical shaped engaging part.

FIG. 7*c* shows a view showing a curved shaped engaging part.

FIG. 7*d* shows a view showing an L shaped engaging part.

The Invention will be described more concretely referring to the following examples.

Embodiment 1

Insert-integral molding with different materials

An attaching part having engaging parts is formed by injection molding using nylon resin.

A previously molded attaching part made of nylon resin is inserted in a metal mold, liquid silicone rubber mixed with nickel powder as a conductive medium is poured into the metal mold, and then a magnetic force is applied to a desired position in the metal mold so as to orient the nickel powder to define a conductive part. After that, the liquid silicone rubber is cross-linked, and an anisotropic connector part and the attaching part are integrated into one piece, thereby obtaining the connector of Embodiment 1.

Figure 1:
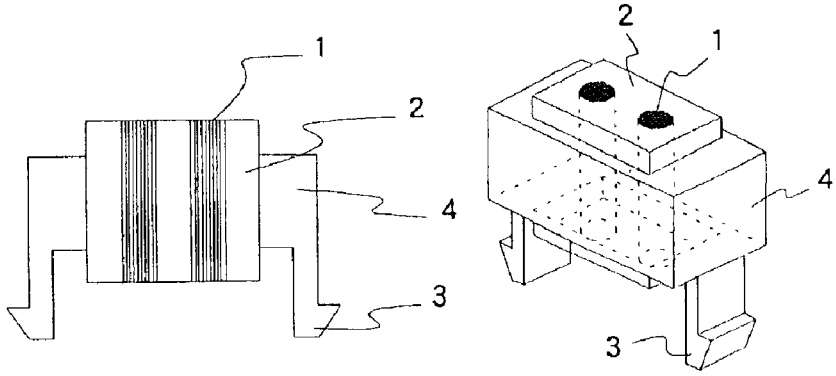
FIG. 1 shows a longitudinal sectional view and a perspective view of an embodiment of a connector in accordance with the present invention.
Figure 2:
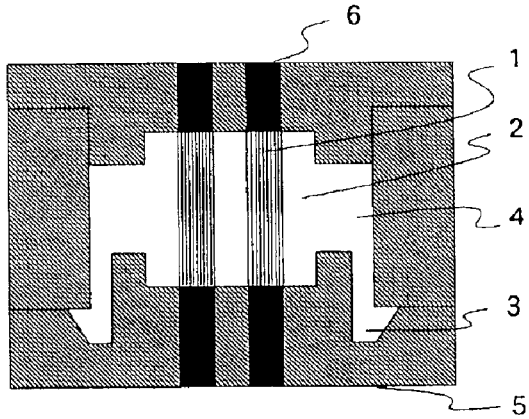
FIG. 2 shows a longitudinal sectional view showing an example of a metal mold for the connector in accordance with the present invention.
Figure 3:
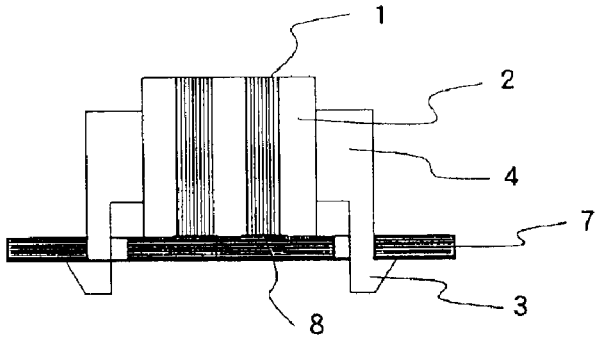
FIG. 3 shows a longitudinal sectional view showing an example of the connector in accordance with the present invention attached to a substrate.

FIG. 3 is an assembly view of a simple attachment type connector in Example 1 of the present invention. As shown in FIG. 3, a connector wherein the attaching part 4 made of nylon resin having the engaging parts 3 and the elastic anisotropic connector part 2 made of silicone rubber having the conductive part 1 formed by orienting nickel powder by means of magnetic force are integrated into one piece is attached to a substrate 7 with the conductive part 1 being contacted with electrodes 8 of the substrate 7.

The anisotropic connector part 2 of the connector of Embodiment 1 is fitted into the attaching part 4 which is hollow. The anisotropic connector part 2 is compressed by an electronic part (not-shown) and the substrate and thereby shows a stable resistance value. Since the whole side surface of the anisotropic connector part 2 is not covered by the attaching part 4, the anisotropic connector part 2 is bent when being compressed, and therefore load in compression can be suppressed low. In this embodiment, the engaging parts 3 are of outward claw shapes but may be of inward claw shapes. Moreover, by providing engaging parts on the top surface of the attaching part 4, it is also possible to facilitate attachment to the electronic parts.

Embodiment 2

Figure 4A:
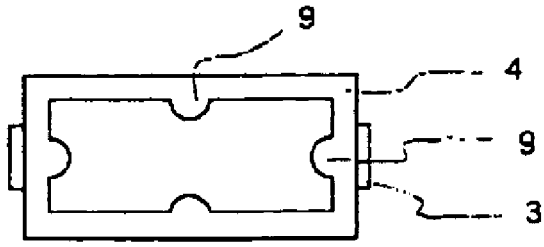
FIG. 4*a* shows a top view showing an example of the attaching part in accordance with the present invention.
Figure 4B:
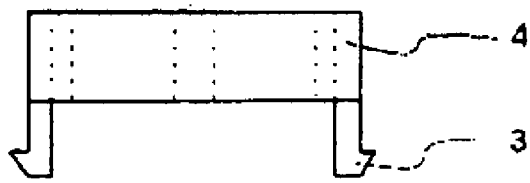
FIG. 4*b* shows a side view showing an example of the attaching part in accordance with the present invention.
Figure 5A:
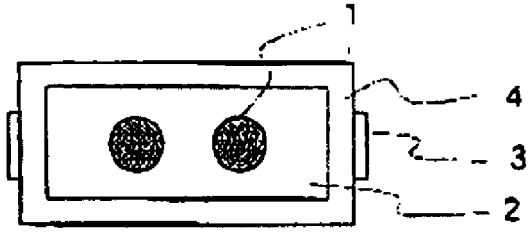
FIG. 5*a* shows a top view showing an embodiment of the connector in accordance with the present invention.
Figure 5B:
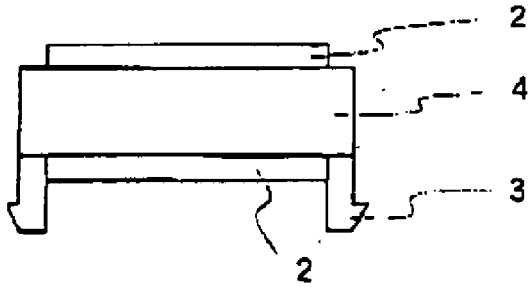
FIG. 5*b* shows a side view showing an embodiment of the connector in accordance with the present invention.

Integration of an anisotropic connector part and an attaching part by fitting their projections into recesses Using polyacetal resin, the attaching part 4 having engaging parts, as shown in FIG. 4, is formed by injection molding. Convex ribs 9 are provided on the inner peripheral side surface of a hollow portion of the attaching part.

A previously molded attaching part 4 made of polyacetal resin is inserted in a metal mold, liquid silicone rubber mixed with gold-coated nickel powder as conductive medium is poured into the metal mold, and a magnetic force is applied to a desired position in the metal mold so as to orient the gold-coated nickel powder to specify a part of the conductive part 1 so as to form an anisotropic connector part 2. After that, the liquid silicone rubber is cross-linked to integrate the anisotropic connector part with the attaching part 4, thereby obtaining the connector of Embodiment 2.

As shown in FIG. 6, the method of manufacturing the connector in accordance with the present invention includes no soldering process for connecting lead wires, etc. and comprises only an assembly process of parts, and so the assembling can be simplified. The connector wherein the attaching part 4 made of polyacetal resin having the engaging part 3 and an elastic anisotropic connector part 2 made of silicone rubber having the conductive part 1 formed by orienting a desire position of gold-coated nickel powder by means of magnetic force are integrated into one piece is attached to the substrate 7 with the conductive part 1 being contacted with the electrode 8 of the substrate 7. Thus, a stable conduction between the connector, an electronic part 10 and an electrode 11 can be obtained.

According to the present invention, since as described above, the connector is used to connect electrodes of the electronic parts and electrodes of the substrate, the soldering process for connecting lead wires, etc. can be eliminated. Moreover, simplification of the assembly process allows reduction of the manufacturing cost. Further, since the connector has a conductive part formed by orienting a conductive medium by means of magnetic force, a stable electrical connection can be obtained even if load in compression is low, and pressure being applied to the inside of the case can be reduced.

Further, according to the manufacturing method of the present invention, it is possible to easily manufacture the connector wherein the attaching part having engaging parts of complex shape as used for being fitted in substrate or electronic parts and the anisotropic connector part are integrated into one piece.

What is claimed is:

1. An electrical connector for connecting electrodes of a substrate to electrodes of an electronic part, the electronic part being part of an engaging electronic device, the connector comprising:

an electrically anisotropic connector part is made of a rubber elastic having conductive portions for electrically connecting the electrodes of the substrate to the electrodes of the electronic part;

an attaching part connected to said anisotropic connector part, said attaching part includes a monolithically formed engaging part that is deformable for quick attaching and de-attaching said anisotropic connector part to one of the substrate and the electronic part.

2. An electrical connector in accordance with claim 1, wherein:

said engaging part locks said anisotropic connector part and said attaching part to the one of the substrate and the electronic part.

3. An electrical connector in accordance with claim 1, wherein:

said engaging part fixes said anisotropic connector part and said attaching part to the one of the substrate and the electronic part, to render said anisotropic connector part and said attaching part immobile in a direction away from the one of the substrate and the electronic part.

4. An electrical connector in accordance with claim 1, wherein:

said engaging part locks said anisotropic connector part and said attaching part to the one of the substrate and the electronic part, to render said anisotropic connector part and said attaching part immobile in a direction parallel to the one of the substrate and the electronic part.

5. An electrical connector in accordance with claim 1, wherein:

said engaging part has hooks which engage with the one of the substrate and the electronic part.

6. An electrical connector in accordance with claim 5, wherein:

the one of the substrate and the electronic part has holes which engage with said hooks.

7. An electrical connector in accordance with claim 1, wherein:

said engaging part biases said anisotropic connector part against the one of the substrate and the electronic part.

8. An electrical connector in accordance with claim 1, wherein:

said engaging part is an integral part of said attaching part.

9. An electrical connector in accordance with claim 1, wherein:

said engaging, said attaching part and said anisotropic connector part are integral with each other.

10. An electrical connector in accordance with claim 2, wherein:

said engaging part fixes said anisotropic connector part and said attaching part to the one of the substrate and the electronic part in a direction perpendicular and parallel to the one of the Substrate and the electronic part;

said engaging part has hooks which engage with the one of the substrate and the electronic part;

the one of the substrate and the electronic part has holes which engage with said hooks;

said engaging part biases said anisotropic connector part against the one of the substrate and the electronic part;

said engaging, said attaching part and said anisotropic connector part are integral with each other.

11. A connector as claimed in claim 1, wherein the anisotropic connector part having a conductive part formed by orienting a conductive medium by means of a magnetic force.

12. A connector as claimed in claim 11, wherein the conductive medium is a magnetic conductive element.

13. A connector as claimed in claim 11, wherein the attaching part to be attached to the electronic parts or the substrate is made of a material selected from the group consisting of a rubber elastic element, a rigid resin, metal, ceramics and a combination of them.

14. A connector as claimed in claim 12, wherein the attaching part to be attached to the electronic parts or the substrate is made of a material selected from the group consisting of a rubber elastic element, a rigid resin, metal, ceramics and a combination of them.

15. A connector as claimed in claim 1, wherein the attaching part to be attached to the electronic part or the substrate is made of a material selected from the group consisting of a rubber elastic element, a rigid resin, metal, ceramics and a combination of them.

* * * * *